US009810074B2

(12) United States Patent
Lee et al.

(10) Patent No.: US 9,810,074 B2
(45) Date of Patent: Nov. 7, 2017

(54) SEGMENTED TURBINE BLADE SQUEALER TIP AND COOLING METHOD

(71) Applicant: Siemens Aktiengesellschaft, München (DE)

(72) Inventors: Ching-Pang Lee, Cincinnati, OH (US); Kok-Mun Tham, Oviedo, FL (US); Gm Salam Azad, Oviedo, FL (US)

(73) Assignee: SIEMENS AKTIENGESELLSCHAFT, München (DE)

( * ) Notice: Subject to any disclaimer, the term of this patent is extended or adjusted under 35 U.S.C. 154(b) by 0 days.

(21) Appl. No.: 15/318,001

(22) PCT Filed: Jul. 7, 2014

(86) PCT No.: PCT/US2014/045512
§ 371 (c)(1),
(2) Date: Dec. 12, 2016

(87) PCT Pub. No.: WO2016/007116
PCT Pub. Date: Jan. 14, 2016

(65) Prior Publication Data

US 2017/0122110 A1 May 4, 2017

(51) Int. Cl.
*F01D 5/18* (2006.01)
*F01D 5/14* (2006.01)

(52) U.S. Cl.
CPC ..... *F01D 5/187* (2013.01); *F01D 5/147* (2013.01); *F05D 2220/32* (2013.01); *F05D 2230/53* (2013.01); *F05D 2240/307* (2013.01); *F05D 2260/22141* (2013.01)

(58) Field of Classification Search
CPC . F01D 5/187; F01D 5/147; F01D 5/14; F01D 5/18; F01D 5/20; F05D 2230/53
See application file for complete search history.

(56) References Cited

U.S. PATENT DOCUMENTS 4,761,116 A 8/1988 Braddy et al.
6,059,530 A * 5/2000 Lee ..... F01D 5/145 416/96 A
6,179,556 B1 * 1/2001 Bunker ..... F01D 5/187 415/115

(Continued)

FOREIGN PATENT DOCUMENTS

EP 1057972 A2 12/2000

OTHER PUBLICATIONS

PCT International Search Report and Written Opinion dated Sep. 18, 2014 corresponding to PCT Application PCT/US2014/045512 filed Jul. 7, 2014. (10 pages).

*Primary Examiner* — Craig Kim
*Assistant Examiner* — Maxime Adjagbe

(57) ABSTRACT

Gas turbine engine blade squealer tips incorporate cooling slots formed in the suction side rail downstream of the leading edge for directing cooling gas flow along an inside edge of the squealer tip pressure side rail. Some embodiments incorporate a tip fin on the suction side rail proximal a cooling slot. Segmented suction side rail embodiments abrade opposing turbine casing abradable surfaces prior to potential contact with the pressure side rail, reducing likelihood of pressure side rail friction heating. During turbine engine operation cooler pressure side rails reduce likelihood of squealer tip erosion.

17 Claims, 7 Drawing Sheets

(56) References Cited

U.S. PATENT DOCUMENTS

| | | | | |
|---|---|---|---|---|
| 2012/0237358 | A1 | 9/2012 | Campbell | |
| 2013/0149163 | A1* | 6/2013 | Parkos, Jr. ..... | F01D 5/20<br>416/224 |
| 2014/0037458 | A1 | 2/2014 | Lacy et al. | |

* cited by examiner

SEGMENTED TURBINE BLADE SQUEALER TIP AND COOLING METHOD

TECHNICAL FIELD

The invention relates to gas turbine engine blade squealer tips and methods for cooling gas turbine engine squealer tips. More particularly, embodiments of the invention relate to cooling slots and tip fins formed in squealer tip rails for directing cooling gas flow along an inside edge of the squealer tip pressure side rail. Segmented suction side rail embodiments abrade opposing turbine casing abradable surfaces prior to potential contact with the pressure side rail, reducing likelihood of pressure side rail friction heating.

BACKGROUND ART

Known gas turbine engines incorporate shaft-mounted turbine blades circumferentially circumscribed by a turbine casing or housing. Hot gasses flowing past the turbine blades cause blade rotation that converts thermal energy within the hot gasses to mechanical work, which is available for powering rotating machinery, such as an electrical generator. Referring to FIGS. 1-4, known turbine engines, such as the gas turbine engine 30 include a multi stage compressor section 32, a combustor section 34, a multi stage turbine section 36 and an exhaust system 38. Atmospheric pressure intake air is drawn into the compressor section 32 generally in the direction of the flow arrows F along the axial length of the turbine engine 30. The intake air is progressively pressurized in the compressor section 32 by rows rotating compressor blades and directed by mating compressor vanes to the combustor section 34, where it is mixed with fuel and ignited. The ignited fuel/air mixture, now under greater pressure and temperature than the original intake air, is directed to the sequential rows $R_1$, $R_2$, etc., in the turbine section 36. The engine's rotor and shaft 39 has a plurality of rows of airfoil cross sectional shaped turbine blades 40 terminating in distal blade squealer tips 46 in the compressor 32 and turbine 36 sections. For convenience and brevity further discussion of turbine blades and abradable layers in the engine will focus on the turbine section 36 embodiments and applications, though similar constructions are applicable for the compressor section 32. Each blade 40 has a concave profile pressure side 42 and a convex suction side 44. The high temperature and pressure combustion gas, flowing in the combustion flow direction F imparts rotational motion on the blades 40, spinning the rotor 39*s*. As is well known, some of the mechanical power imparted on the rotor shaft is available for performing useful work. The combustion gasses are constrained radially distal the rotor by turbine casing 60 and proximal the rotor by air seals. Referring to the Row 1 section shown in FIG. 2, and the perspective view of the same blade 40 in FIG. 3, respective upstream vanes 62 direct upstream combustion gases generally parallel to the incident angle of the leading edge 48 of turbine blade and downstream vanes redirect downstream combustion gas exiting the trailing edge 50 of the blade.

The turbine engine 30 turbine casing 60 proximal the blade squealer tips 46 is lined with a plurality of sector shaped abradable components 64, each having a support surface retained within and coupled to the casing 60 and an abradable substrate 66 that is in opposed, spaced relationship with the blade tip by a blade tip gap G. The abradable substrate is often constructed of a metallic/ceramic material that has high thermal and thermal erosion resistance and that maintains structural integrity at high combustion temperatures. As the abradable surface 66 metallic-ceramic materials is often more abrasive than the turbine blade tip 46 material a blade tip gap G is maintained to avoid contact between the two opposed components that might at best cause premature blade tip wear and in worse case circumstances might cause engine damage.

In addition to the desire to prevent blade tip 46 premature wear or contact with the abradable substrate 66, for ideal airflow and power efficiency each respective blade tip 46 desirably has a uniform blade tip gap G relative to the abradable component 64 that is as small as possible (ideally zero clearance) to minimize blade tip airflow leakage L between the concave pressure blade side 42 and the convex suction blade side 44 as well as axially in the combustion flow direction F. However, manufacturing and operational tradeoffs require blade tip gaps G greater than zero. Such tradeoffs include tolerance stacking of interacting components, so that a blade constructed on the higher end of acceptable radial length tolerance and an abradable component abradable substrate 66 constructed on the lower end of acceptable radial tolerance do not impact each other excessively during operation. Similarly, small mechanical alignment variances during engine assembly can cause local variations in the blade tip gap G. For example in a turbine engine of many meters axial length, having a turbine casing abradable substrate 66 inner diameter of multiple meters, very small mechanical alignment variances can impart local blade tip gap G variances of a few millimeters.

During turbine engine 30 operation the turbine engine casing 60 may experience out of round (e.g., egg shaped) thermal distortion. Casing 60 thermal distortion potential increases between operational cycles of the turbine engine 30 as the engine is fired up to generate power and subsequently cooled for servicing after thousands of hours of power generation. Commonly, greater casing 60 and abradable component 64 distortion tends to occur at the uppermost and lowermost casing circumferential positions (i.e., 6:00 and 12:00 positions) compared to the lateral right and left circumferential positions (i.e., 3:00 and 9:00). For example, if casing distortion at the 6:00 position causes blade tip contact with the abradable substrate 66 one or more of the blade tip squealers 46 may be worn during operation, increasing the blade tip gap locally in various other less deformed circumferential portions of the turbine casing 60 from the ideal gap G to a larger gap. The excessive blade gap distortion increases blade tip leakage L, diverting hot combustion gas away from the turbine blade 40 airfoil, reducing the turbine engine's efficiency.

The exemplary blade 40 squealer tip 46 construction and its interaction with the turbine casing abradable surface 66 is shown in greater detail in FIGS. 3-6. The squealer tip 46 has a an airfoil planform tip plate 56 having along its outer periphery downstream from its leading edge 48 and upstream from its trailing edge 50 opposed and laterally separated outwardly or radially projecting concave pressure 52 and convex suction 54 rails, which respectively have opposed inner faces and outer faces. An enclosed tip cavity 57 is defined between the tip plate 56 and respective inner faces of the pressure rail 52 (also referenced in FIG. 4 as the pressure rail inner surface 53) and suction rail 54 from the leading 48 to trailing 50 edges. Referring to the streamline simulation of gas flow between and around the squealer tip 46 and the abradable surface (the abradable surface is not shown for clearer flow streamline viewing), pressure side gas flow $F_P$ is deflected around the leading edge 48 and separates from contact with the pressure side rail 52, allowing heat to concentrate on the outer face of the pressure rail.

Such excessive heat concentration can cause pressure rail 52 erosion, prematurely wearing out the blade and undesirably increasing the blade tip gap, as previously described. Combustion gas flow $F_T$ undesirably passes through the blade tip gap over the top of the squealer tip 46, but most of it is diverted away from the pressure rail inner surface 53 toward the suction side rail, creating another potential heat concentration zone along the pressure rail inner surface. Gas flow $F_S$ along the suction side 44 of the blade tip 46 is directed toward the blade trailing edge 50, where it cannot assist in transfer of heat from the pressure rail 52 heat concentration zone. As previously mentioned, friction contact between the squealer tip 46 pressure rail 52 and the abradable surface 46 also undesirably increases pressure rail area heat concentration.

Another known conventional blade squealer tip 146 is shown in FIG. 7, having a segmented pressure side rail 152 with a slot 158 proximal the squealer tip 146 trailing edge 150. In this embodiment the suction side rail 154 is continuous downstream from the leading edge 148 to the trailing edge 150. The rails 152, 154 and the underlying tip plate (not shown) form the squealer tip cavity 157.

SUMMARY OF INVENTION

Accordingly, a suggested object is to reduce turbine blade squealer tip wear by decreasing squealer tip pressure rail operating temperature through increased cooling air flow along an inside surface of the pressure rail.

Another suggested object is to reduce turbine blade squealer tip wear by decreasing squealer tip pressure rail operating temperature through reduced contact between the pressure rail and the engine's opposed abradable surface. Reduction or elimination of pressure rail contact with the abradable surface reduces likelihood of rubbing friction heating of the pressure side rail.

These and other objects are achieved in one or more exemplary embodiments by gas turbine engine blade squealer tips that incorporate cooling slots formed in the suction side rail downstream of the leading edge for directing cooling gas flow along an inside edge of the squealer tip pressure side rail. Some embodiments incorporate a tip fin on the suction side rail proximal a cooling slot. Segmented suction side rail embodiments abrade opposing turbine casing abradable surfaces prior to potential contact with the pressure side rail, reducing likelihood of pressure side rail friction heating. During turbine engine operation cooler pressure side rails reduce likelihood of squealer tip erosion.

Exemplary embodiments feature a gas turbine engine blade squealer tip, comprising an airfoil planform tip plate having along its outer periphery downstream from its leading edge and upstream from its trailing edge opposed and laterally separated projecting concave pressure and convex suction rails respectively having inner and outer faces. An enclosed tip cavity is defined between the tip plate and respective inner faces of the pressure and suction rails from the leading to trailing edges. At least one slot is formed through respective inner and outer faces of the suction rail downstream of the leading edge. The slot is in communication with the tip cavity and is oriented for directing cooling air flow there through and downstream along the pressure rail inner face. These blade squealer tips in method embodiments for cooling a gas turbine engine that includes a rotor having blades radially projecting therefrom, with blade squealer tips in opposed relationship with a circumferential abradable layer supported by a turbine casing. The method is performed by providing and installing turbine blades having the afore described blade squealer tips and operating the engine so that cooling air flows downstream along the pressure rail inner face and through the slot that is formed through respective inner and outer faces of the suction rail downstream of the leading edge.

Additional embodiments feature a method for manufacturing a gas turbine engine blade squealer tip pressure side rail by providing a turbine blade with an airfoil planform tip plate having along its outer periphery downstream from its leading edge and upstream from its trailing edge opposed and laterally separated projecting concave pressure and convex suction rails respectively having inner and outer faces and an enclosed tip cavity defined between the tip plate and respective inner faces of the pressure and suction rails from the leading to trailing edges. A location is determined for at least one slot in the blade tip through respective inner and outer faces of the suction rail downstream of the leading, with the slot in communication with the tip cavity and oriented for directing cooling air flow there through and downstream along the pressure rail inner face. The slot is formed in the blade tip at the determined location.

Other embodiments feature a gas turbine engine, comprising a rotor having blades radially projecting therefrom, with each blade having a squealer tip including an airfoil planform tip plate having along its outer periphery downstream from its leading edge and upstream from its trailing edge opposed and laterally separated projecting concave pressure and convex suction rails respectively having inner and outer faces. The squealer tip includes an enclosed tip cavity defined between the tip plate and respective inner faces of the pressure and suction rails from the leading to trailing edges. At least one slot is formed through respective inner and outer faces of the pressure rail downstream of the leading edge. Each respective slot is in communication with the tip cavity and is oriented for directing cooling air flow there through and downstream along the pressure rail inner face.

The respective objects and features of the exemplary embodiments may be applied jointly or severally in any combination or sub-combination by those skilled in the art.

BRIEF DESCRIPTION OF DRAWINGS

The teachings of the invention can be readily understood by considering the following detailed description in conjunction with the accompanying drawings, in which.

To facilitate understanding, identical reference numerals have been used, where possible, to designate identical elements that are common to the figures.

DESCRIPTION OF EMBODIMENTS

After considering the following description, those skilled in the art will clearly realize that the teachings of the present invention can be readily utilized to reduce heat concentration along squealer tip pressure rails of gas turbine engine blades, in order to reduce likelihood of tip wear that reduces blade service life and decreases engine operating efficiency when worn blade tips increase engine blade tip gap. In exemplary embodiments of the invention, turbine blade squealer tips incorporate one or more cooling slots formed in the suction side rail downstream of the leading edge. These slots are oriented for directing cooling gas flow along an inside edge of the squealer tip pressure side rail, so that heat concentration along the pressure side rail is transported away from hottest zone of the squealer tip. Some embodiments incorporate a tip fin on the suction side rail proximal a cooling slot. Segmented suction side rail embodiments abrade opposing turbine casing abradable surfaces (analogous to a snow plow) prior to potential contact with the pressure side rail, reducing likelihood of pressure side rail friction heating. During turbine engine operation cooler pressure side rails reduce likelihood of squealer tip erosion.

Figure 1:
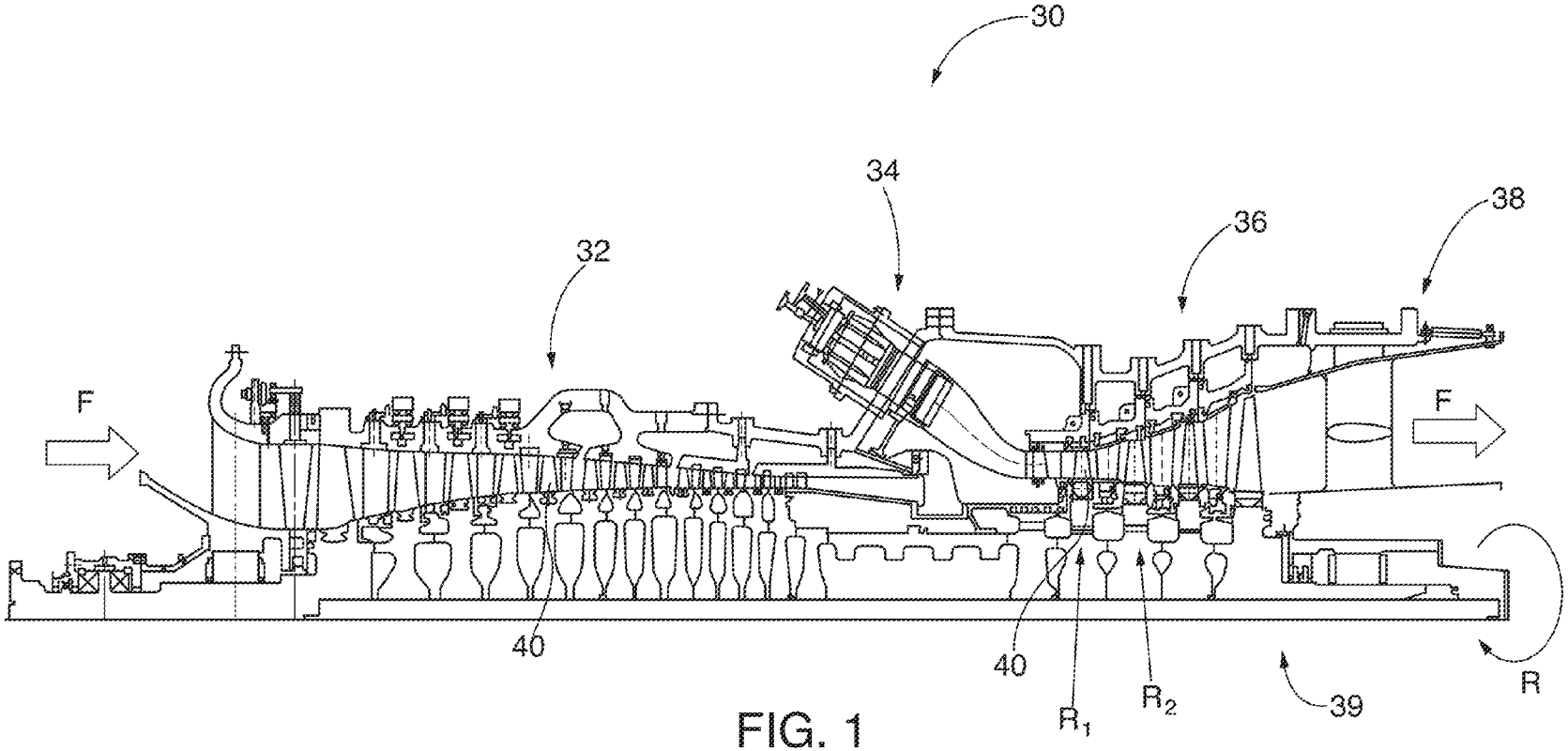
FIG. 1 is a partial axial cross sectional view of an exemplary known gas turbine engine.
Figure 2:
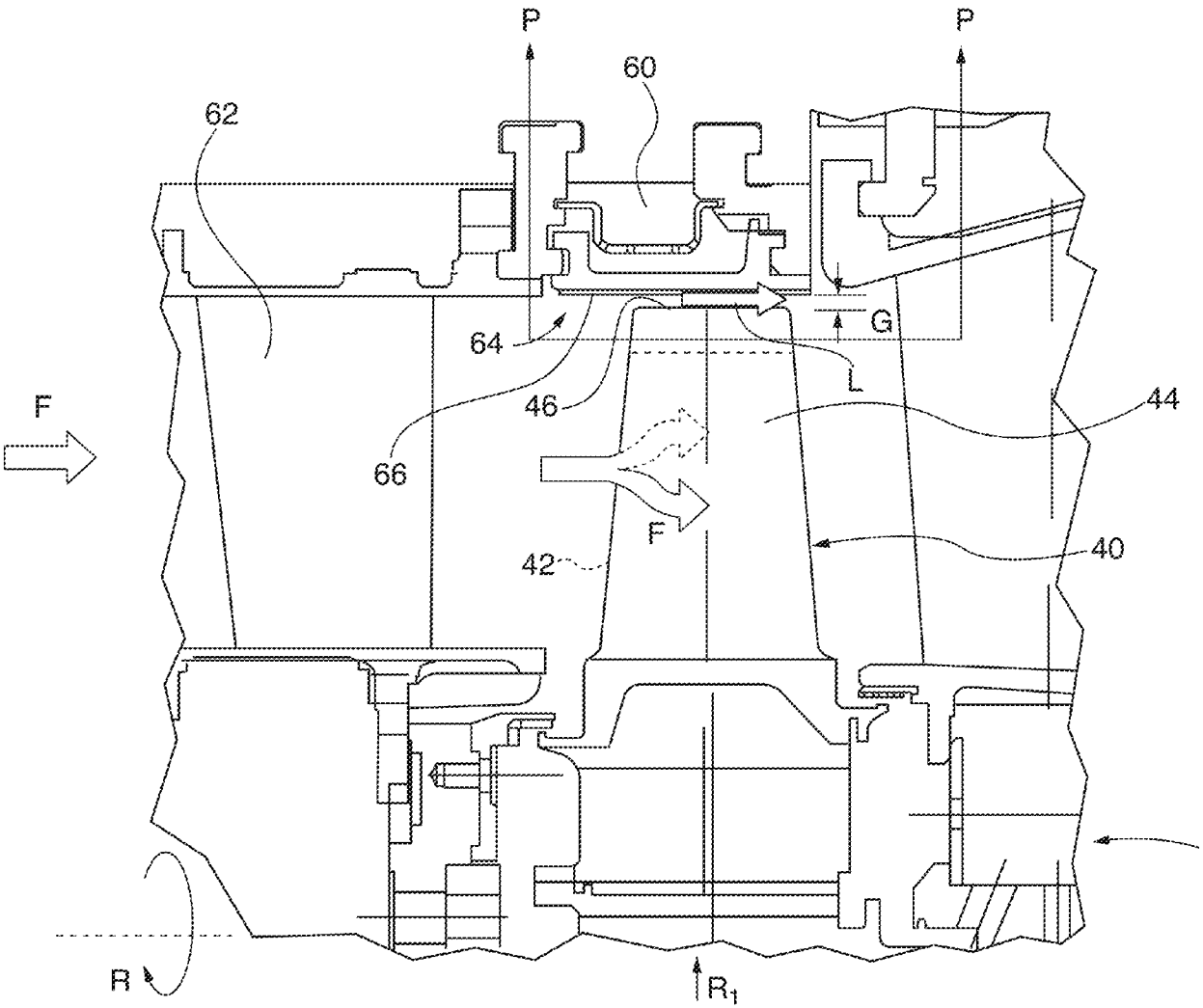
FIG. 2 is a detailed cross sectional elevational view of a known Row 1 turbine blade and vanes showing blade tip gap G between a blade tip and abradable component of the turbine engine of FIG. 1.
Figure 3:
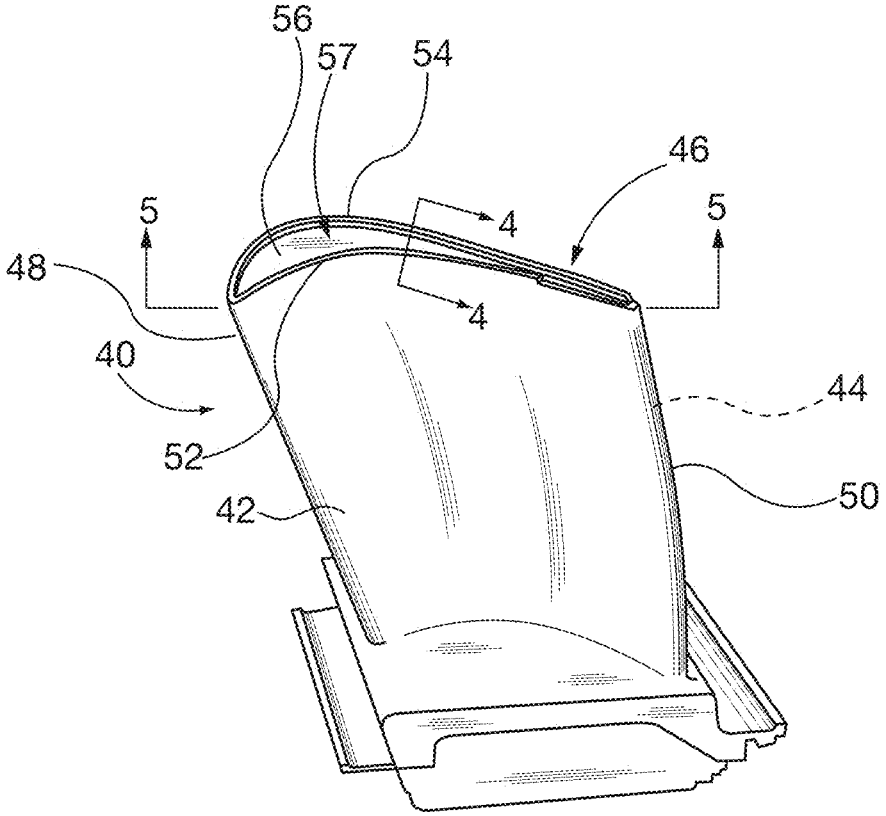
FIG. 3 PRIOR ART
FIG. 3 is a perspective view of the exemplary known turbine blade of FIGS. 1 and 2 with a closed squealer tip having continuous pressure side and suction side rails.
Figure 4:
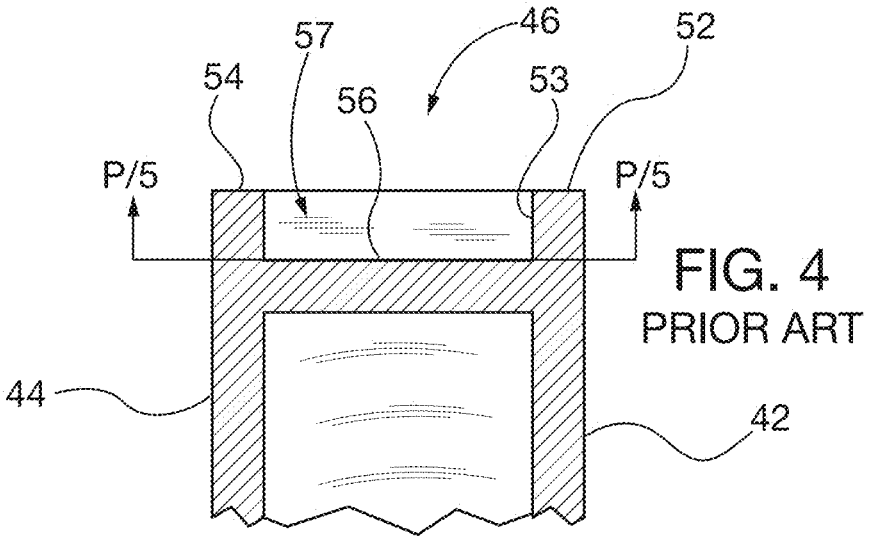
FIG. 4 PRIOR ART
FIG. 4 is an elevational cross sectional view of the known turbine blade and squealer tip of FIG. 3 taken along 3-3.
Figure 5:
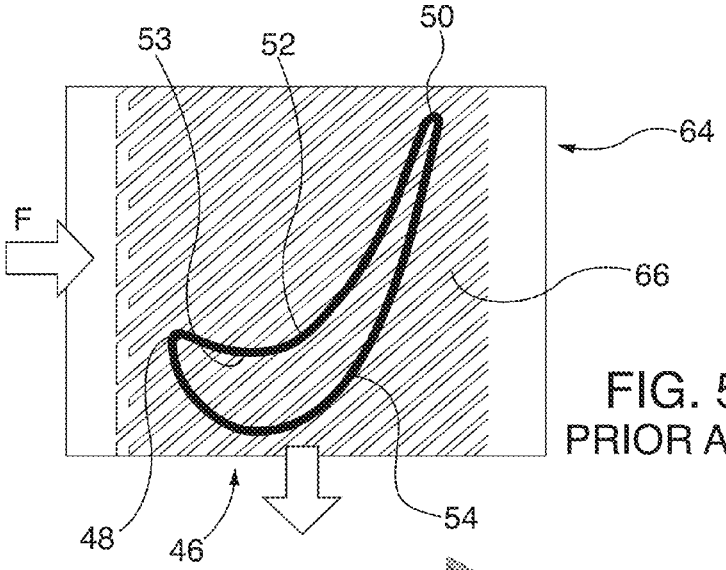
FIG. 5 PRIOR ART
FIG. 5 is a schematic plan form view of the known squealer tip of FIGS. 3 and 4 its opposed orientation and motion relative to a turbine engine abradable surface.
Figure 6:
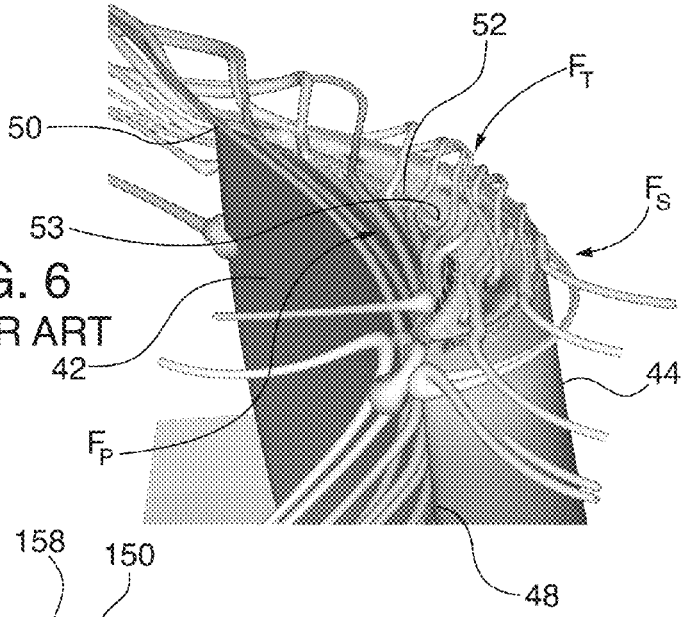
FIG. 6 PRIOR ART
FIG. 6 is a streamline flow simulation of gas flow around the known turbine blade squealer tip and abradable surface of FIG. 5.
Figure 7:
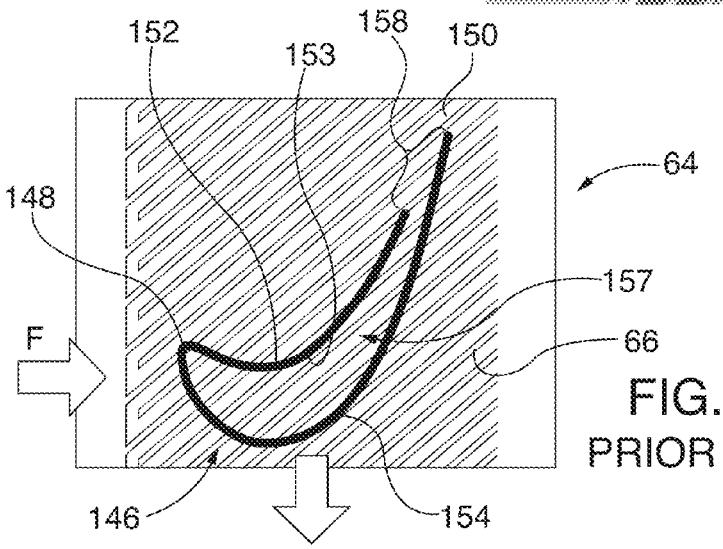
FIG. 7 PRIOR ART
FIG. 7 is a schematic plan form view similar to FIG. 5, of another known squealer tip and its opposed relative orientation and motion relative to a turbine engine abradable surface.
Figure 8:
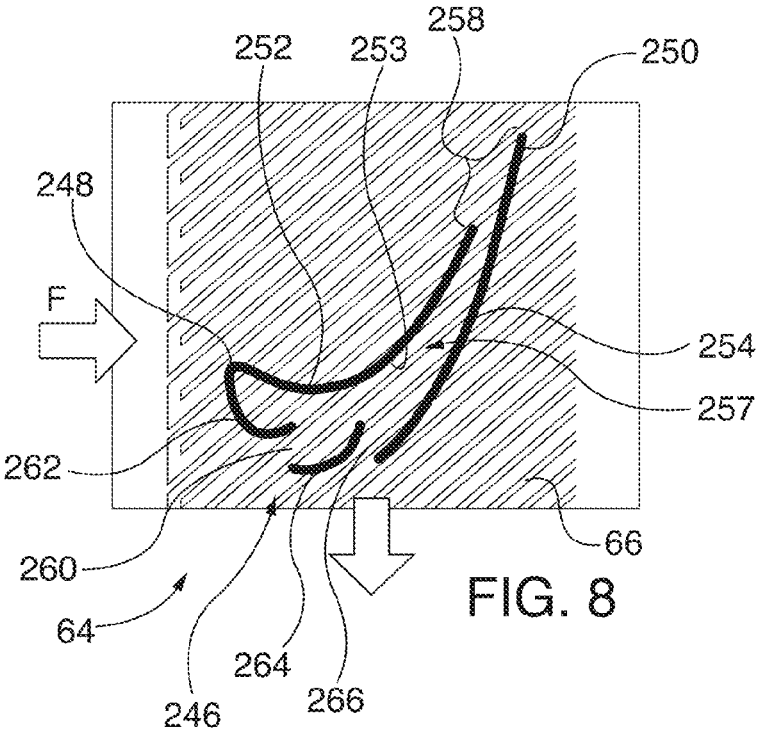
FIG. 8 is a schematic plan form view similar to FIG. 7, of an exemplary first embodiment of a squealer tip of the invention and its opposed relative orientation and motion relative to a turbine engine abradable surface.
Figure 9:
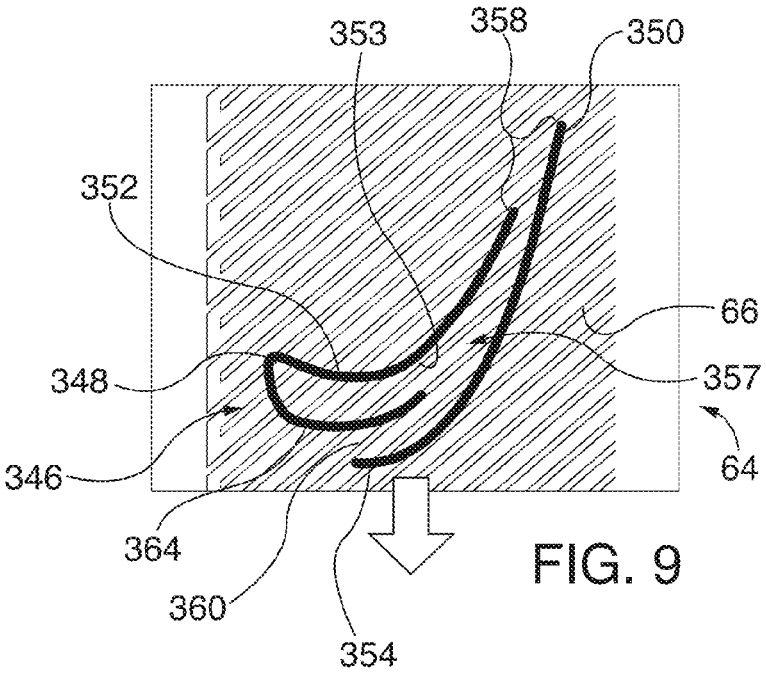
FIG. 9 is a schematic plan form view similar to FIG. 7, of an exemplary second embodiment of a squealer tip of the invention and its opposed relative orientation and motion relative to a turbine engine abradable surface.
Figure 10:
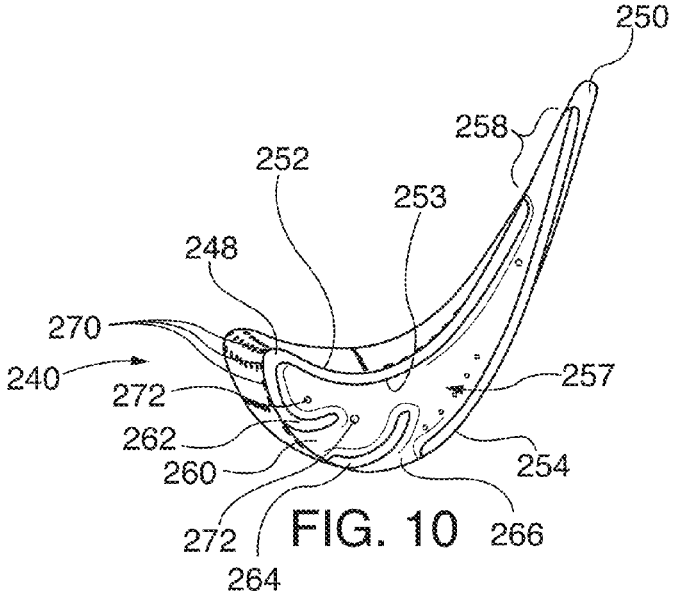
FIG. 10 is a top elevational view of a turbine blade that incorporates the first embodiment squealer tip of FIG. 8.
Figure 11:
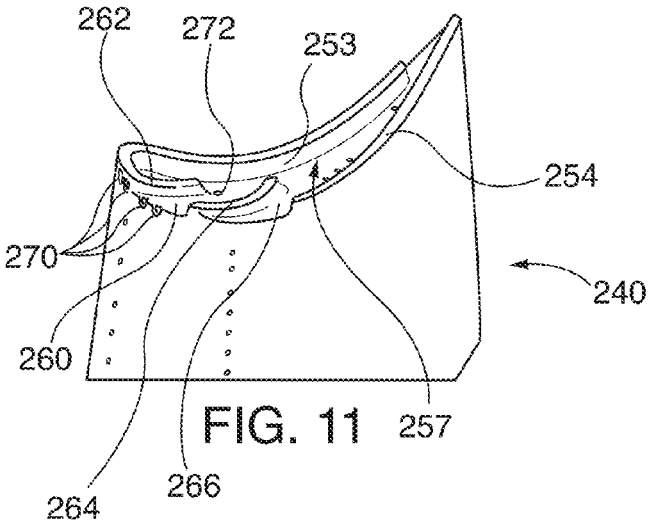
FIG. 11 is a perspective view of the turbine blade of FIG. 10.
Figure 12:
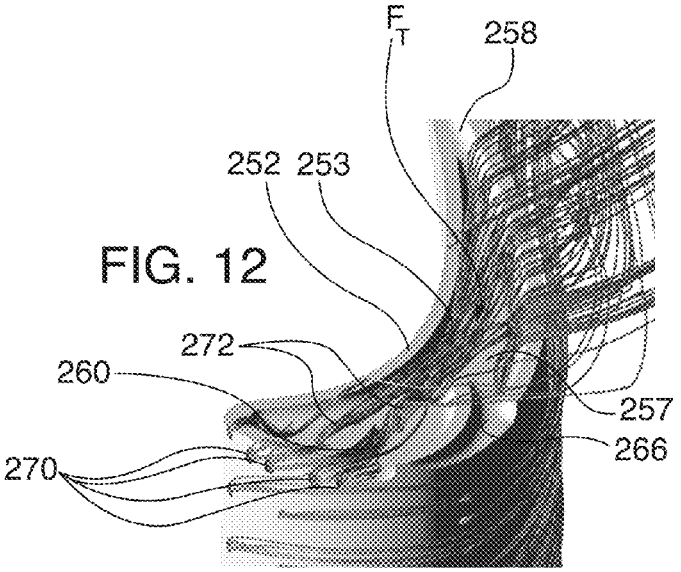
FIG. 12 is a streamline flow simulation of gas flow around the turbine blade with the first embodiment squealer tip of FIG. 8.
Figure 13:
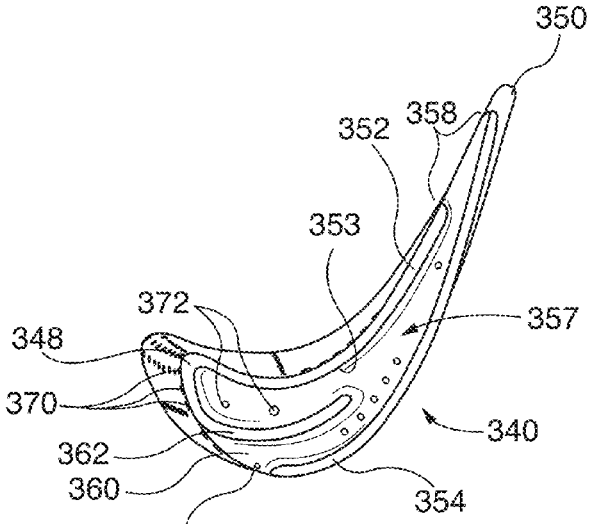
FIG. 13 is a top elevational view of a turbine blade that incorporates the second embodiment squealer tip of FIG. 9.
Figure 14:
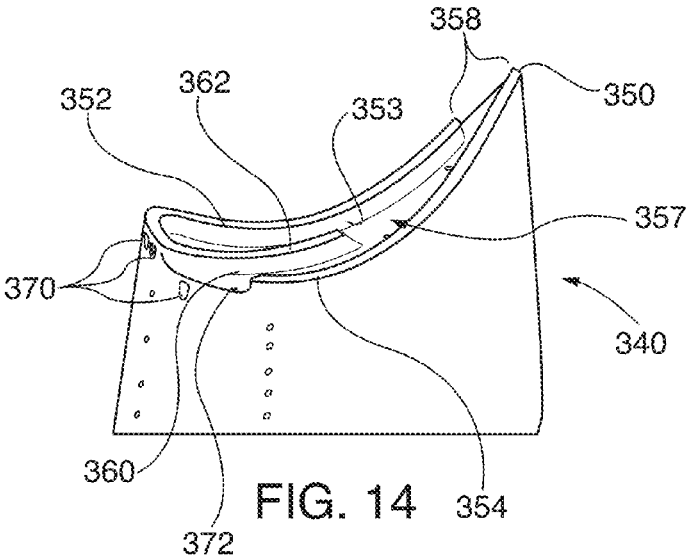
FIG. 14 is a perspective view of the turbine blade of FIG. 13.

A more complete understanding of the benefits of the construction and function of the slotted or segmented squealer tip embodiments of the invention becomes apparent when compared to those of the known conventional squealer tip of FIGS. 3-7. The known conventional blade tip 46/146 has a unified, continuous squealer rail of uniform thickness on both concave pressure 52/152 and convex suction 54/154 sides. During the engine rotation, when there is a contact between the squealer and the ring segment, the suction side squealer is the first to cut into the ring segment. From the gas flow simulation CFD analysis as shown in FIG. 6, the gas flow past the leading edge 48 of the tip 46 splits into two streams, one toward the pressure side 42 and one toward the suction side 44. The suction side gas stream $F_S$ enters into the tip cavity at the forward section and mixes with the leakage flow from the pressure side $F_P$ at the downstream location before exiting to the suction side in the downstream section. The invention embodiments of FIGS. 8 and 9, each respectively with a segmented suction side squealer 254/354 allows more of the suction side gas stream $F_S$ to enter into the tip cavity 257/357 and pressurize the tip cavity (analogous to a static wall) that will lead to less leakage $F_P$ from the pressure side 252/352. The segmented squealer designs that include the fins 262/264/254 or 364/354 provide laterally overlapped squealers on their respective suction side to have more cutting power to the abradable ring segment patterns and have a better chance to preserve the pressure side squealer 252/352 for better sealing. The segmented and overlapped suction side 262/264/254 or 364/354 squealer construction embodiments of FIGS. 8 and 9 have more durable blade tips and less performance robbing tip leakage than the conventional squealer tip 46/146 designs of FIGS. 5 and 7. Two exemplary embodiments of squealer tips constructed in accordance with the teachings of the invention are shown in FIGS. 8-15.

Figure 15:
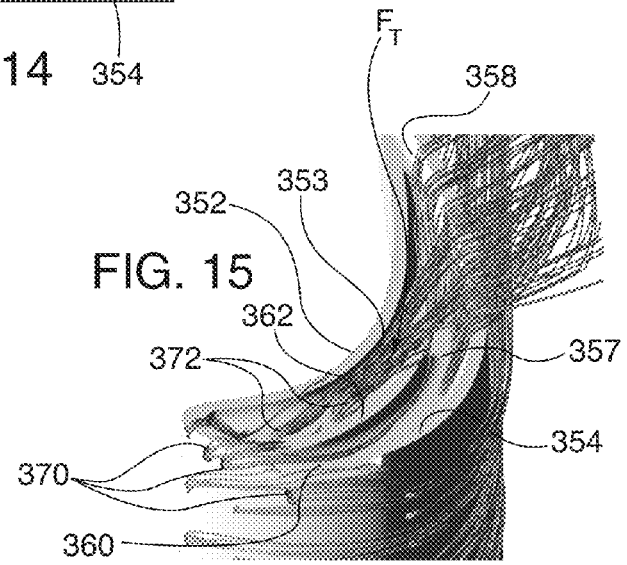
FIG. 15 is a streamline flow simulation of gas flow around the turbine blade with the second embodiment squealer tip of FIG. 9.

A first exemplary embodiment blade 240 with squealer tip 246 is shown in FIGS. 8 and 10-12, having the previously described segmented suction side downstream of the leading edge 248, formed from first fin 262, second fin 264 and suction rail 254. First slot 260 and second slot 266 allow communication between the suction side of the blade 240 and the tip cavity 257, as does the optional slot 258 formed in the pressure rail 252 proximal the trailing edge 250. In this exemplary embodiment the squealer tip is formed with the first and second slots 260, 266 with or without the slot 258. As shown in FIG. 15, cooling gas flow $F_T$ within the cavity 257 is directed along the pressure rail inner face 253, thereby transporting heat away from the pressure rail 252. Additional beneficial gas flow through the squealer tip cavity 257 along the pressure rail inner face 253 is optionally provided by adding cooling holes 270 along the suction side or cooling holes 272 in the tip cavity or at both locations.

A second exemplary embodiment blade 340 with squealer tip 346 is shown in FIGS. 9 and 13-15, having the previously described segmented suction side downstream of the leading edge 348, formed from first fin 362 and suction rail 354. First slot 360 allows communication between the suction side of the blade 340 and the tip cavity 357, as does the optional slot 358 formed in the pressure rail 352 proximal the trailing edge 350. In this exemplary embodiment the squealer tip 346 is formed with the first slot 360 with or without the slot 358. As shown in FIG. 18, cooling gas flow $F_T$ within the cavity 357 is directed along the pressure rail inner face 353, thereby transporting heat away from the pressure rail 352. Additional beneficial gas flow through the squealer tip cavity 357 along the pressure rail inner face 353 is optionally provided by adding cooling holes 370 along the suction side or cooling holes 372 in the tip cavity or at both locations.

Although various embodiments that incorporate the teachings of the present invention have been shown and described in detail herein, those skilled in the art can readily devise many other varied embodiments that still incorporate these teachings. The invention is not limited in its application to the exemplary embodiment details of construction and the arrangement of components set forth in the description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass direct and indirect mountings, connections, supports, and couplings. Further, "connected" and "coupled" are not restricted to physical or mechanical connections or couplings.

What is claimed is:

1. A gas turbine engine blade squealer tip, comprising:

an airfoil planform tip plate having along its outer periphery downstream from its leading edge and upstream from its trailing edge opposed and laterally separated projecting concave pressure and convex suction rails respectively having inner and outer faces;

an enclosed tip cavity defined between the tip plate and respective inner faces of the pressure and suction rails from the leading to trailing edges;

at least one slot formed through respective inner and outer faces of the suction rail downstream of the leading edge, the slot in communication with the tip cavity and oriented for directing cooling air flow there through and downstream along the pressure rail inner face; and a first tip fin projecting from the tip plate, having an upstream portion proximal the suction rail, a downstream portion oriented in the tip cavity and an outer face defining an upstream side of a first slot formed in the suction rail, the first tip fin oriented for directing cooling air flow through the first slot and downstream along the pressure rail inner face.

2. The squealer tip of claim 1, further comprising the first tip fin laterally spaced from and overlapping a portion of the suction rail that forms a downstream side of the first slot.

3. The squealer tip of claim 1, further comprising a second tip fin projecting from the tip plate downstream of the first tip fin, the second tip fin having an upstream portion proximal the suction rail, a downstream portion oriented in the tip cavity and an outer face defining an upstream side of a second slot formed in the suction rail, the second tip fin oriented for directing cooling air flow through the second slot and downstream along the pressure rail inner face.

4. The squealer tip of claim 3, further comprising the second fin laterally spaced from and overlapping a portion of the first fin.

5. The squealer tip of claim 4, further comprising first, second and third cooling holes formed in the tip plate, wherein:

the first cooling hole is oriented in the tip cavity between the first tip fin and the pressure rail;

the second cooling hole is oriented proximal the first slot between first fin and second fins; and the third cooling hole is oriented proximal the second slot between the second fin and the suction rail;

the cooling holes oriented for introducing cooling air into the blade tip cavity that is subsequently directed along the pressure rail inner face.

6. The squealer tip of claim 1, further comprising at least one cooling hole in the turbine blade that is oriented proximal the slot for introducing cooling air into the blade tip cavity that is subsequently directed along the pressure rail inner face.

7. The squealer tip of claim 1, further comprising at least one cooling hole in the tip plate that is oriented in the tip cavity between the first tip fin and the pressure rail, for introducing cooling air into the blade tip cavity that is subsequently directed along the pressure rail inner face.

8. A method for manufacturing a gas turbine engine blade squealer tip pressure side rail, comprising:

providing a turbine blade with an airfoil planform tip plate having along its outer periphery downstream from its leading edge and upstream from its trailing edge opposed and laterally separated projecting concave pressure and convex suction rails respectively having inner and outer faces and an enclosed tip cavity defined between the tip plate and respective inner faces of the pressure and suction rails from the leading to trailing edges;

determining a location for at least one slot in the blade tip through respective inner and outer faces of the suction rail downstream of the leading, with the slot in communication with the tip cavity and oriented for directing cooling air flow there through and downstream along the pressure rail inner face;

forming the slot in the blade tip at said determined location; and forming a first tip fin projecting from the tip plate, having an upstream portion proximal the suction rail, a downstream portion oriented in the tip cavity and an outer face defining an upstream side of a first slot formed in the suction rail, the first tip fin oriented for directing cooling air flow through the first slot and downstream along the pressure rail inner face.

9. The method of claim 8, further comprising forming the first tip fin in the tip plate laterally spaced from and overlapping a portion of the suction rail that forms a downstream side of the first slot.

10. The method of claim 8, further comprising a forming a second tip fin projecting from the tip plate downstream of the first tip fin, the second tip fin having an upstream portion proximal the suction rail, a downstream portion oriented in the tip cavity and an outer face defining an upstream side of a second slot formed in the suction rail, the second tip fin oriented for directing cooling air flow through the second slot and downstream along the pressure rail inner face.

11. The method of claim 10, further comprising spacing the second fin laterally from and overlapping a portion of the first fin.

12. The method of claim 11, further comprising forming first, second and third cooling holes in the tip plate, wherein:

the first cooling hole is oriented in the tip cavity between the first tip fin and the pressure rail;

the second cooling hole is oriented proximal the first slot between the first fin and the second fin; and the third cooling hole is oriented proximal the second slot between the second fin and the suction rail;

the cooling holes oriented for introducing cooling air into the blade tip cavity that is subsequently directed along the pressure rail inner face.

13. The method of claim 8, further comprising forming at least one cooling hole in the turbine blade that is oriented proximal the slot for introducing cooling air into the blade tip cavity that is subsequently directed along the pressure rail inner face.

14. The method of claim 8, further comprising forming at least one cooling hole in the tip plate that is oriented in the tip cavity between the first tip fin and the pressure rail, for introducing cooling air into the blade tip cavity that is subsequently directed along the pressure rail inner face.

15. A method for cooling a gas turbine engine with a rotor having blades radially projecting therefrom, with blade squealer tips in opposed relationship with a circumferential abradable layer supported by a turbine casing, comprising:

providing and installing turbine blades having the blade squealer tips of claim 1; and operating the engine so cooling air flows downstream along the pressure rail inner face and through the slot that is formed through respective inner and outer faces of the suction rail downstream of the leading edge.

16. The method of claim 15, further comprising:

providing and installing turbine blades having a first tip fin projecting from the tip plate, having an upstream portion proximal the suction rail, a downstream portion oriented in the tip cavity and an outer face defining an upstream side of a first slot formed in the suction rail, the first tip fin laterally spaced from and overlapping a portion of the suction rail that forms a downstream side of the first slot;

abrading the abradable surface with the overlapping first tip fin and suction rail, so that the pressure side rail does not abrade said abradable surface, thereby reducing likelihood of friction heating the pressure side rail that would otherwise result from abrading contact with said abradable surface.

17. A gas turbine engine, comprising:

a rotor having blades radially projecting therefrom;

each blade having a squealer tip including:

an airfoil planform tip plate having along its outer periphery downstream from its leading edge and upstream from its trailing edge opposed and laterally separated projecting concave pressure and convex suction rails respectively having inner and outer faces;

an enclosed tip cavity defined between the tip plate and respective inner faces of the pressure and suction rails from the leading to trailing edges; and at least one slot formed through respective inner and outer faces of the pressure rail downstream of the leading edge, each respective slot in communication with the tip cavity and oriented for directing cooling air flow there through and downstream along the pressure rail inner face; and a first tip fin projecting from the tip plate, having an upstream portion proximal the suction rail, a downstream portion oriented in the tip cavity and an outer face defining an upstream side of a first slot formed in the suction rail, the first tip fin oriented for directing cooling air flow through the first slot and downstream along the pressure rail inner face.

* * * * *